US010274891B2

(12) United States Patent
Aoki

(10) Patent No.: US 10,274,891 B2
(45) Date of Patent: Apr. 30, 2019

(54) SOLID LUBRICANT APPLICATION DEVICE AND IMAGE FORMATION APPARATUS

(71) Applicant: KONICA MINOLTA, INC., Chiyoda-ku, Tokyo (JP)

(72) Inventor: Shingo Aoki, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/811,211

(22) Filed: Nov. 13, 2017

(65) Prior Publication Data

US 2018/0143580 A1 May 24, 2018

(30) Foreign Application Priority Data

Nov. 18, 2016 (JP) ..... 2016-225195

(51) Int. Cl.
*G03G 15/16* (2006.01)
*G03G 15/20* (2006.01)
*G03G 21/00* (2006.01)

(52) U.S. Cl.
CPC ..... *G03G 21/007* (2013.01); *G03G 15/161* (2013.01); *G03G 15/2025* (2013.01); *G03G 21/0094* (2013.01); *G03G 2221/1609* (2013.01)

(58) Field of Classification Search
CPC ..... G03G 15/2075; G03G 2221/1609; G03G 2215/00801
See application file for complete search history.

(56) References Cited

U.S. PATENT DOCUMENTS

2011/0229232 A1* 9/2011 Kojima ..... G03G 21/007 399/346

FOREIGN PATENT DOCUMENTS

| | | | |
|---|---|---|---|
| JP | 2000172118 | A | 6/2000 |
| JP | 2009042274 | A | 2/2009 |
| JP | 2009210938 | A | 9/2009 |
| JP | 2012027135 | A | 2/2012 |
| JP | 2014238437 | A | 12/2014 |

* cited by examiner

*Primary Examiner* — Victor Verbitsky
(74) *Attorney, Agent, or Firm* — Holtz, Holtz & Volek PC

(57) ABSTRACT

A solid lubricant application device includes: a rotating body; a solid lubricant applied to the rotating body; a resilient urging member that causes the solid lubricant to abut toward a circumferential surface of the rotating body; and a guide mechanism that guides movement of the solid lubricant. When a straight line parallel to a direction in which the solid lubricant abuts against the rotating body is referred to as a first straight line, and a straight line parallel to a direction in which the resilient urging member and the solid lubricant are connected is referred to as a second straight line, the guide mechanism guides the movement of the solid lubricant such that an intersecting angle, which is a smaller one of angles formed by the first straight line and the second straight line, decreases as the solid lubricant is applied to the rotating body and accordingly changed in shape.

15 Claims, 16 Drawing Sheets

SOLID LUBRICANT APPLICATION DEVICE AND IMAGE FORMATION APPARATUS

Japanese Patent Application No. 2016-225195 filed on Nov. 18, 2016, including description, claims, drawings, and abstract the entire disclosure is incorporated herein by reference in its entirety.

BACKGROUND

Technological Field

The present invention relates to a solid lubricant application method, a solid lubricant application device and an image formation apparatus equipped therewith.

Description of the Related Art

Conventional image formation apparatuses are disclosed for example in Japanese Laid-Open Patent Publication Nos. 2012-27135, 2014-238437, and 2000-172118.

Japanese Laid-Open Patent Publication No. 2012-27135 discloses an image formation apparatus in which an arm is configured pivotably about one end thereof and has the other end with a lubricant fixed thereto, and an urging means urges the arm's other end in a direction to approach a brush roller. While the arm is caused to pivot such that the other end approaches the brush roller, the solid lubricant is pressed against the brush roller. This can prevent the solid lubricant from being inclined and unevenly worn.

Japanese Laid-Open Patent Publication No. 2014-238437 discloses an image formation apparatus which utilizes variation in physical quantity that is attributed to an amount of a lubricant adhering to a surface of an image carrier to mechanically adjust a force applied by a lubricant supplying unit to supply a lubricant or a force applied by a lubricant removal unit to remove a solid lubricant. This makes it possible to adjust an amount of the solid lubricant adhering to the surface of the image carrier at a law cost without requiring control via software.

Japanese Laid-Open Patent Publication No. 2000-172118 discloses an image formation apparatus comprising a restraint member that restrains a tangential movement of a lubricant caused by rotation of an application brush on a tangential line between a solid lubricant and the application brush, and an urging means that urges the solid lubricant toward the application brush such that a side rearwardly, as observed in a direction in which the application brush rotates, of a contact portion of the solid lubricant and the application brush serves as a point of application. By such a configuration, the restraint member and the urging means can suppress lifting of the solid lubricant caused by the rotation of the application brush, and thus hold the solid lubricant in a predetermined position.

SUMMARY

In the configuration disclosed in Japanese Laid-Open Patent Publication No. 2012-27135, however, while uneven wear of the solid lubricant along an axis of rotation of the brush roller can be suppressed, in a final state in which the solid lubricant is considerably consumed a force exerted by the solid lubricant to press the brush roller is considerably smaller than in an initial state in which the solid lubricant is initially installed.

For this reason, in the final state, the lubricant is supplied to a photoreceptor in a reduced amount, and a toner's external additive adhering to the photoreceptor passes through a cleaning blade. As a result, the brush roller and hence the solid lubricant abutting against it are contaminated. Further, as the solid lubricant is insufficiently supplied, a streak is formed in an image, resulting in a defect therein.

To avoid this phenomenon, when the pressing force in the initial state is increased, the lubricant is supplied to the photoreceptor in an increased amount, and the toner passes through the cleaning blade. This contaminates the brush roller. Farther, a streak is formed in an image, resulting in a defect therein. Thus a large difference between a force exerted by the solid lubricant to press the brush roller in the initial state and a force exerted by the solid lubricant to press the brush roller in the final state results in a poor image.

The configuration disclosed in Japanese Laid-Open Patent Publication No. 2014-238437 suppresses uneven application of the solid lubricant through small vibration and sliding contact wear, and insufficiently considers suppressing a difference between a force exerted by the solid lubricant to press the brush roller in the initial state and a force exerted by the solid lubricant to press the brush roller in the final state.

The configuration disclosed in Japanese Laid-Open Patent Publication No. 2000-172118 suppresses lifting of the solid lubricant, and insufficiently considers suppressing a difference between a force exerted by the solid lubricant to press the brush roller in the initial state and a force exerted by the solid lubricant to press the brush roller in the final state.

The present invention has been made in view of the above issue, and an object of the present invention is to provide a solid lubricant application device capable of suppressing variation of a force exerted by a solid lubricant to press a brush roller varying from an initial state in which the solid lubricant is initially installed toward a final state in which the solid lubricant is considerably consumed, and an image formation apparatus equipped therewith.

To achieve at least one of the abovementioned objects, according to an aspect of the present invention, a solid lubricant application device reflecting one aspect of the present invention comprises: a rotating body that rotates about an axis of rotation, a solid lubricant applied to the rotating body as the solid lubricant abuts against a circumferential surface of the rotating body; a resilient urging member that causes the solid lubricant to abut toward the circumferential surface of the rotating body; and a guide mechanism that guides movement of the solid lubricant caused as the solid lubricant is applied to the rotating body and accordingly changed in shape, when a straight line parallel to a direction in which the solid lubricant abuts against the rotating body is referred to as a first straight line, and a straight line parallel to a direction in which the resilient urging member and the solid lubricant are connected is referred to as a second straight line, the guide mechanism guiding the movement of the solid lubricant such that an intersecting angle, which is a smaller one of angles formed by the first straight line and the second straight line, decreases as the solid lubricant is applied to the rotating body and accordingly changed in shape.

To achieve at least one of the abovementioned objects, according to an aspect of the present invention, an image formation apparatus reflecting one respect of the present invention comprises: an image carrier that carries an image; and a solid lubricant application device, as described above, that applies a lubricant to the image carrier.

To achieve at least one of the abovementioned objects, according to an aspect of the present invention, a solid lubricant application method reflecting one respect of the present invention comprises a method for applying a solid lubricant to a surface of an image carrier by using a solid lubricant application device including a rotating body that rotates about an axis of rotation, a solid lubricant applied to the rotating body as the solid lubricant abuts against a circumferential surface of the rotating body, a resilient urging member that causes the solid lubricant to abut toward the circumferential surface of the rotating body, and a guide mechanism that guides movement of the solid lubricant caused as the solid lubricant is applied to the rotating body and accordingly changed in shape. The solid lubricant application method comprises: causing the rotating body to abut against the surface of the image carrier; and causing the solid lubricant to abut against the circumferential surface of the rotating body. In causing the solid lubricant to abut against the circumferential surface of the rotating body, when a straight line parallel to a direction in which the solid lubricant abuts against the rotating body is referred to as a first straight line, and a straight line parallel to a direction in which the resilient urging member and the solid lubricant are connected is referred to as a second straight line, the guide mechanism guides the movement of the solid lubricant such that an intersecting angle, which is a smaller one of angles formed by the first straight line and the second straight line, decreases as the solid lubricant is applied to the rotating body and accordingly changed in shape.

BRIEF DESCRIPTION OR THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

Figure 21:
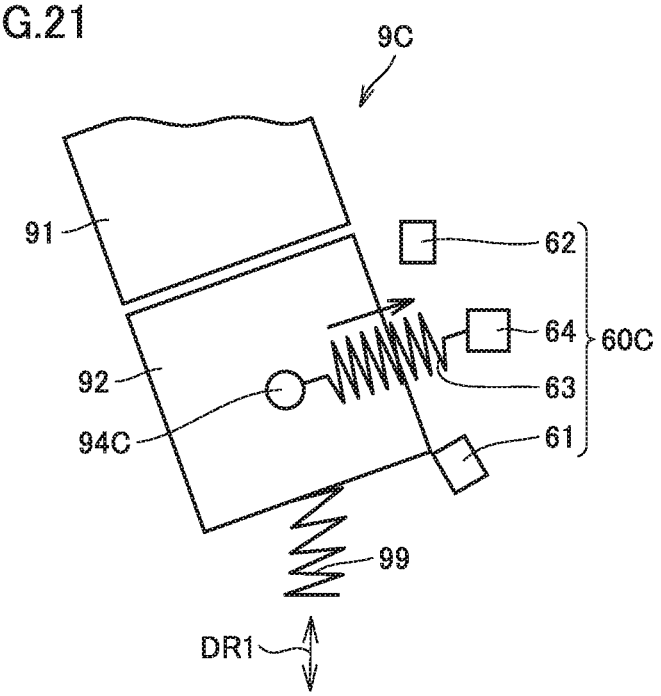

FIG. 21 a side second state of the solid lubricant application device according to the fourth embodiment.

Figure 22:
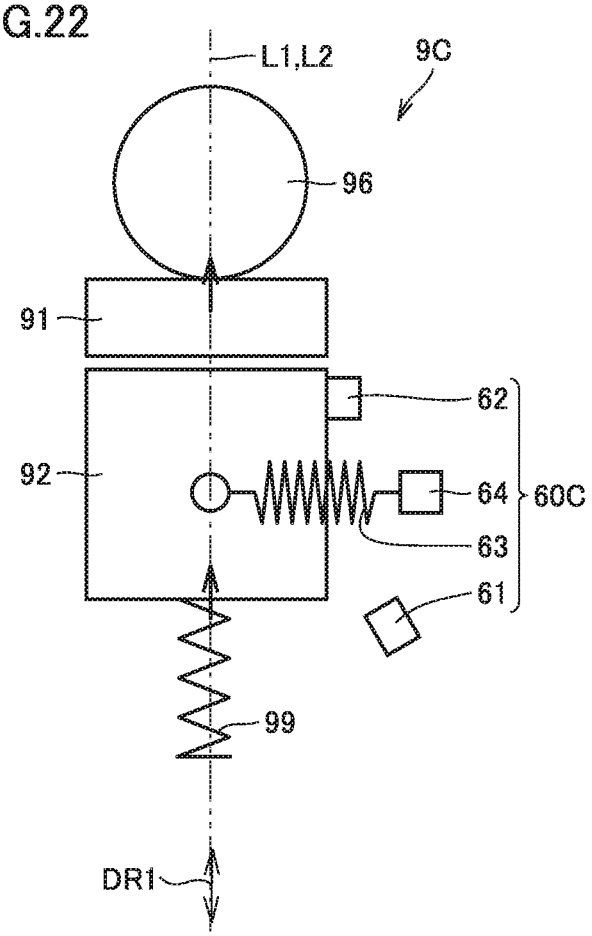

FIG. 22 is a side showing a third state of the solid lubricant application device according to the fourth embodiment.

DETAILED DESCRIPTION OF EMBODIMENTS

Hereinafter, one or more embodiments of the present invention will be described with reference to the drawings. However, the scope of the invention is not limited to the disclosed embodiments. In the following embodiments, identical or common components are identically denoted in the figures and will not be described repeatedly.

First Embodiment

Figure 1:
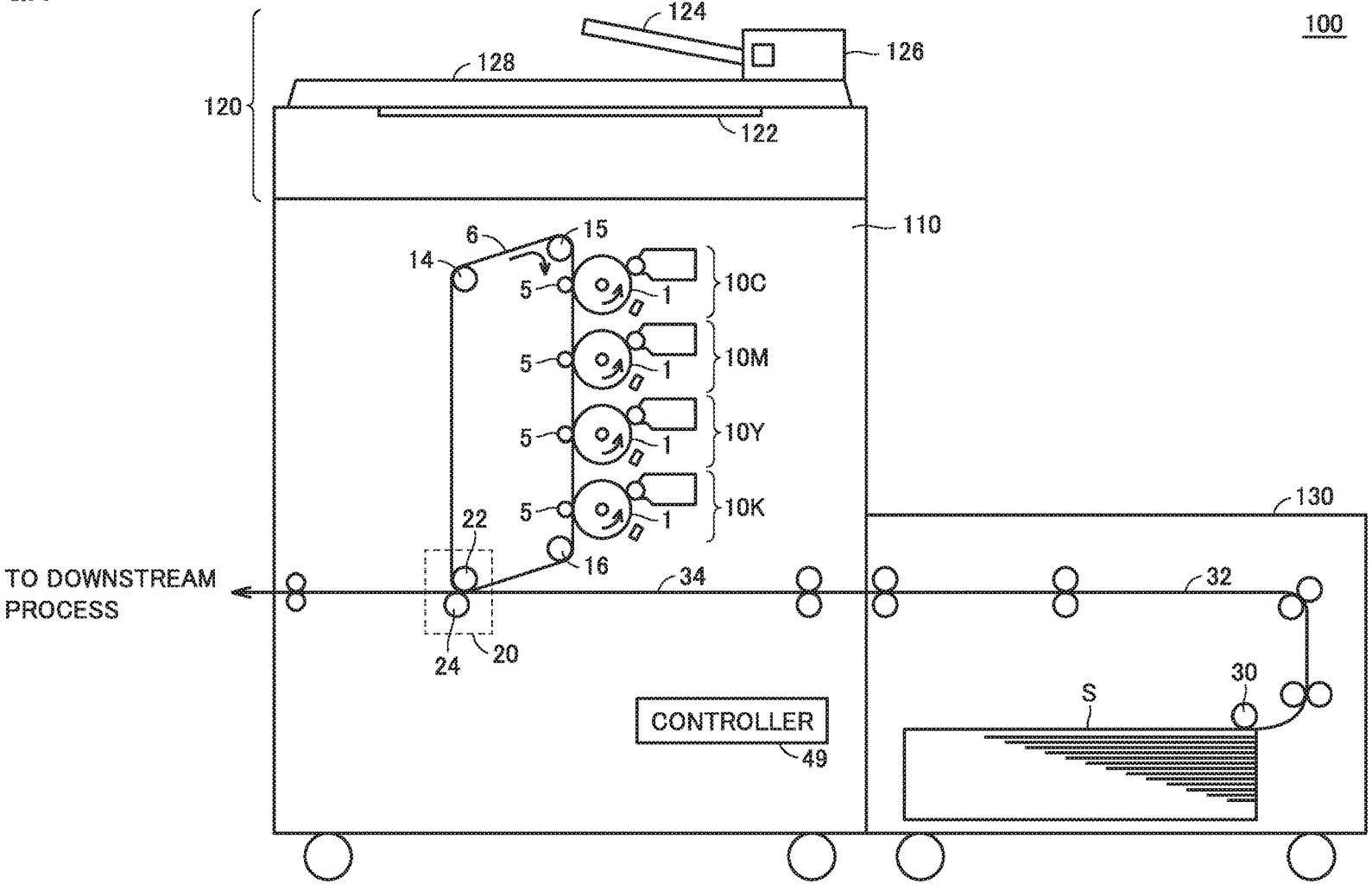
FIG. 1 is a schematic diagram of an image formation apparatus according to a first embodiment.

FIG. 1 is a schematic diagram an a formation apparatus according to a first embodiment. With reference to FIG. 1, an image formation apparatus 100 according to the first embodiment will be described.

As shown in FIG. 1, image formation apparatus 100 according to the first embodiment includes a print engine 110, an original document reading unit 120, and a sheet feeding unit 130.

Print engine 110 performs an electrophotographic image formation process. The configuration shown in FIG. 1 allows full-color printout. A medium S printed out is discharged to a downstream process.

Original document reading unit 120 reads an original document and outputs a read result as an image input to print engine 110. More specifically, original document reading unit 120 includes an image scanner 122, an original document feeding plate 124, an automatic original document feeder 126, and an original document discharging table 128.

Image seamier 122 scans an original document disposed on a platen glass. Image scanner 122 includes, as main components, a light source that irradiates an original document with light, an image sensor that obtains an image generated as light emitted from the light source is reflected by the original document, an AD (Analog to Digital) converter for outputting an image signal from the image sensor, and an imaging optical system disposed at a stage preceding the image sensor.

Automatic original document feeder 126 successively scans an original document disposed on original document feeding plate 124. An original document disposed on original document feeding plate 124 is delivered, one at a time, by a delivery roller (not shown) and successively scanned by image scanner 122 or an image sensor disposed inside automatic original document feeder 126. The scanned original document is discharged to original document discharging table 128.

Sheet feeding unit 130 feeds medium S successively to print engine 110. Specifically, sheet feeding unit 130 successively delivers held media S by a delivery roller 30, and also transports the delivered medium S to print engine 110 along a transport path 32.

In print engine 110, medium S fed from sheet feeding unit 130 is transported to a discharging port along a transport path 34. In the process of transporting medium S along transport path 34, a fixing device 20 transfers and fixes a toner image to median S. Fixing device 20 includes a pressure applying roller 22 and a heating roller 24, and transfers to medium S a toner image formed on an intermediate transfer body 6.

Print engine 110 includes image forming units 10C, 10M, and 10K (hereinafter also collectively referred to as an "image forming unit 10") forming toner images of cyan (C), magenta (M), (Y), and black (K), respectively.

In FIG. 1 is shown by way of example a configuration in which a toner image formed by each image forming unit 10 is transferred via the intermediate transfer body to a member to which the toner image is transferred, i.e., medium S. Image formation apparatus 100 includes as the intermediate transfer body an intermediate transfer body 6 tensioned by intermediate transfer body driving rollers 14, 15, 16. Intermediate transfer body 6 is rotated in a prescribed direction as intermediate transfer body driving rollers 14, 15, 16 are rotatably driven. As intermediate transfer body 6, an intermediate transfer belt shown in FIG. 1 may be replaced with an intermediate transfer roller. Note that while FIG. 1 shows by way of example a configuration in which after a toner image has once been transferred to the intermediate transfer body the toner image is transferred to medium S by fixing device 20, a toner image on photoreceptor 1 may be transferred directly to medium S.

Image forming units 10C, 10M, 10Y, 10K are disposed in that order along intermediate transfer body 6 tensioned in print engine 110 and rotatably driven. Each image forming unit 10 includes a photoreceptor 1 and an intermediate transfer device 5. Photoreceptor 1 and intermediate transfer device 5 are disposed to face each other with intermediate transfer body 6 interposed therebetween.

Print engine 110 includes a controller 49 which generally controls image formation apparatus 100. Controller 49 includes as main components a processor such as a CPU (Central Processing Unit), a volatile memory such as DRAM (Dynamic Random Access Memory), a non-volatile memory such as HDD (Hard Disk Drive), and various interfaces. Typically, in print engine 110, the processor executes various programs stored in the non-volatile memory to perform a process or the like involved in forming an image in image formation apparatus 100.

While controller 49 is implemented by the processor executing a program, alternatively, the process may entirely or partially be implemented using dedicated hardware. Furthermore, when the processor executes a program, the program may be installed to the non-volatile memory via various storage media or may be downloaded from a server device etc. (not shown) via a communication line.

Figure 2:
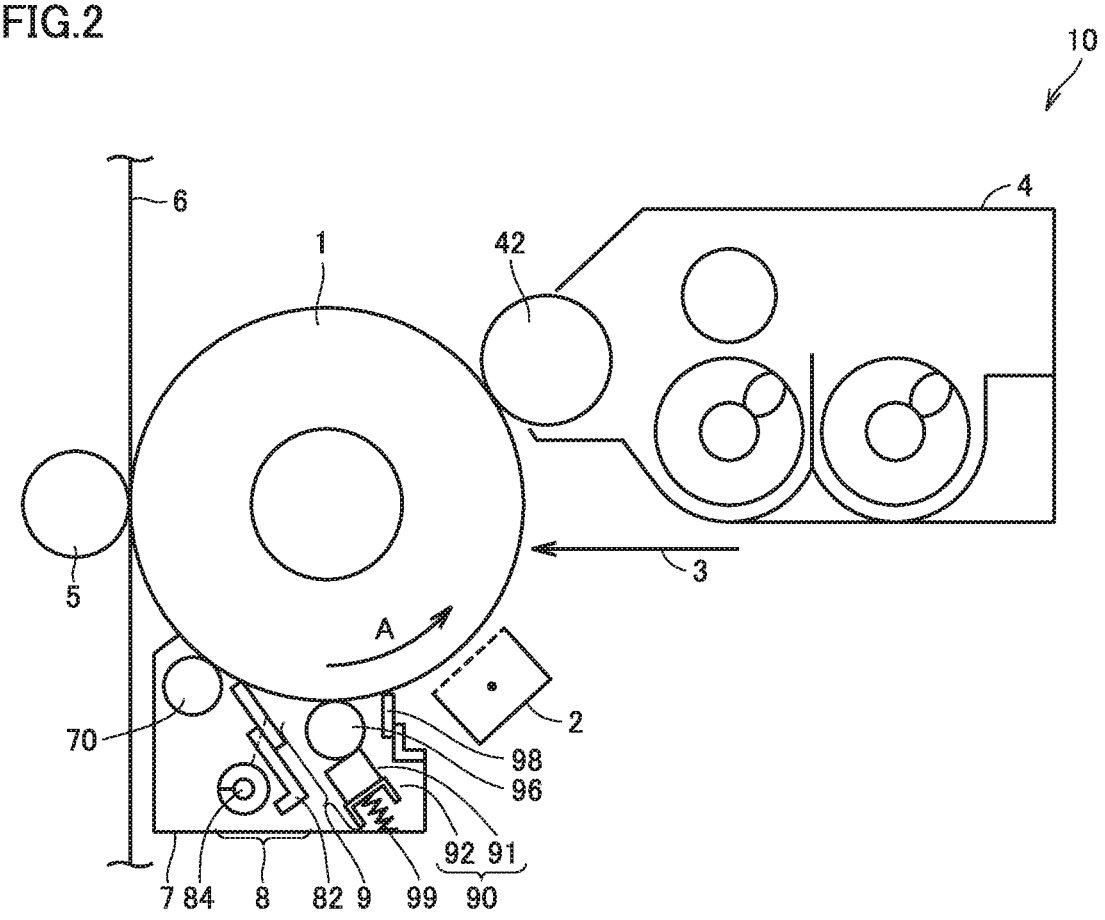
FIG. 2 is a schematic diagram of an image forming unit according to the first embodiment.

FIG. 2 is a schematic diagram of an image forming unit according to the first embodiment. With reference to FIG. 2, image forming unit 10 will be described.

As shown in FIG. 2, image forming unit 10 includes photoreceptor 1, intermediate transfer device 5, a lubricant application adjustment unit 7, a charging device 2, and a developing device 4. Around photoreceptor 1 are disposed charging device 2, an exposure device 3, developing device 4, and a cleaning device 8, which will be described later.

Photoreceptor 1 is an image carrier which carries a toner image thereon, and a photoreceptor roller having a surface with a photosensitive layer formed thereon is used therefor. Photoreceptor 1 is disposed to allow a toner image to be formed on a surface thereof and also rotates in a direction corresponding to a direction in which intermediate transfer body 6 rotates. Note that as the image carrier, the photoreceptor roller may be replaced with a photoreceptor belt. On photoreceptor 1, an electrostatic latent image is formed by exposure device 3, and by developing device 4, the electrostatic latent image is developed to form a toner image.

Charging device 2 includes an electrifying charger etc., and charges a surface of photoreceptor 1 uniformly to attain a prescribed potential.

Exposure device 3 exposes a surface of photoreceptor 1 to light by laser writing etc. according to a designated image pattern to form an electrostatic latent image on that surface. Typically, exposure device 3 includes a laser diode which generates laser light, and a polygon mirror which exposes the surface of photoreceptor 1 to the laser light in a main scanning direction.

Developing device 4 has a developing sleeve 42 disposed opposite to photoreceptor 1 with a developing area interposed, and uses developing sleeve 42 to develop the electrostatic latent image formed on photoreceptor 1 as a toner image. To developing sleeve 42, a developing bias with an alternating current voltage superposed on a direct current voltage of the same polarity as a charging polarity of charging device 2, for example, is applied, and by this developing bias, a toner adheres to the electrostatic latent image formed by exposure device 3.

As a developer used in developing device 4, a two-component based developer which includes a toner and a carrier for electrically charging the toner can typically be used. The toner is not limited to any particular toner, and a known toner can be used. For example, a binder resin which has a colorant and, as required, a charge controlling agent and a release agent, etc. contained therein and in that condition, has an external additive added thereto, may be used as the toner. As the external additive, fine particles of a metal oxide of silica, titanium or the like can be used, and line particles thereof ranging from a small particle diameter of 30 nm to a relatively large particle diameter of 100 nm may be used. The toner's particle diameter is not particularly limited, and preferably, it is about 3-15 μm for example. The carrier is not limited to any particular carrier and a known carrier can be used. For example, a binder type carrier, a coat type carrier, etc. can be used. The carrier's particle diameter is not limited to any particular particle diameter, and preferably it is 15 to 100 μm for example. Note that the two-component based developer is not exclusive and a monocomponent based developer (i.e., a toner) may be used.

The toner image formed on photoreceptor 1 by developing device 4 is carried to a transferring area formed between photoreceptor 1 and intermediate transfer device 5. To intermediate transfer device 5 is applied a transferring bias opposite in polarity to a charging polarity of the toner, and by this transferring bias, in the transferring area, the toner image on photoreceptor 1 is transferred to intermediate transfer body 6. Thus, intermediate transfer device 5 transfers the toner image to a medium, or intermediate transfer body 6.

A toner which has not been transferred to intermediate transfer body 6 in the transferring area and instead remains on photoreceptor 1 is transported to cleaning device 8 and removed by cleaning device 8. Cleaning device 8 recovers a toner which remains on photoreceptor 1 after the toner image is transferred. Furthermore, photoreceptor 1 having a toner on a surface thereof removed by cleaning device 8 is again charged by charging device 2 and a next electrostatic latent image and a next toner image are formed. Such a series of image forming operations is repeated.

As cleaning device 8, a blade cleaning system is typically adopted in which a cleaning blade in the form of a flat plate composed of an elastic body is abutted against a surface of photoreceptor 1 to remove a residual toner on photoreceptor 1.

Lubricant application adjustment unit 7 feeds a lubricant on photoreceptor 1 and also adjusts a toner on photoreceptor 1 in amount to stabilize the thickness of a coating lubricant layer formed on a surface of photoreceptor 1 (or the amount of the lubricant present on the surface of photoreceptor 1). That is, lubricant application adjustment unit 7 applies the lubricant on photoreceptor 1 and also recovers a toner present on photoreceptor 1 upstream of cleaning device 8.

Lubricant application adjustment unit 7 includes a recovery brush 70, cleaning device 8, a solid lubricant application device 9, and a fixing blade 98.

Cleaning device 8 includes a cleaning blade 82 and a transporting screw 84 which transports a toner. Typically, cleaning blade 82 is composed of polyurethane rubber or the like processed into a sheet. As transporting screw 84 is rotatable driven, a toner recovered by cleaning blade 82 is transported to a toner accommodation unit (not shown).

Solid lubricant application device 9 is disposed downstream of cleaning device 8. Solid lubricant application device 9 applies a solid lubricant 91, which will be described later, to photoreceptor 1. Solid lubricant application device 9 includes an application unit 90 having solid lubricant 91 and a support member 92, a brush roller 96, and a resilient urging member 99.

Brush roller 96 is a rolled blush member, and configured to rotate in a direction opposite to that in which photoreceptor 1 rotates. Brush roller 96 abuts against photoreceptor 1 and thus rotates. Solid lubricant 91 abuts against a circumferential surface of brush roller 96. Solid lubricant 91 is pressed against the circumferential surface of brush roller 96 by resilient urging member 99. Resilient urging member 99 can for example be a spring.

Brush roller 96 rotates and thus shaves off a portion of solid lubricant 91 and also transports the powdery lubricant shaved off solid lubricant 91 to photoreceptor 1 to feed the lubricant to a surface of photoreceptor 1. The powdery lubricant transported to photoreceptor 1 is typically drawn on photoreceptor 1 by a fixing mechanism (i.e., fixing blade 98) disposed downstream thereof to form a coating lubricant layer on a surface of photoreceptor 1.

Fixing blade 98, as well as cleaning blade 82 is composed of polyurethane rubber processed into a sheet or the like. Fixing blade 98 abuts preferably in a direction in which it is dragged relative to photoreceptor 1 (such that it is trailed).

A residual toner present on photoreceptor 1 will be recovered by cleaning blade 82. Furthermore, a portion of the lubricant present on photoreceptor 1 will be recovered by brush roller 96 of solid lubricant application device 9, and also mixed with the powdery lubricant shaved off solid lubricant 91, and thus again applied to photoreceptor 1.

Recovery brush 70 has a toner recovery function. Recovery brush 70 is disposed upstream of cleaning device 8. Recovery brush 70 is a rolled conductive brush member, and configured to rotate in the same direction as photoreceptor 1. As recovery brush 70 rotates, it recovers a portion of a residual toner present on photoreceptor 1, and the recovered toner is shaved off recovery brush 70 by a flicker member (not shown) and thus accommodated in the accommodation unit.

Figure 3:
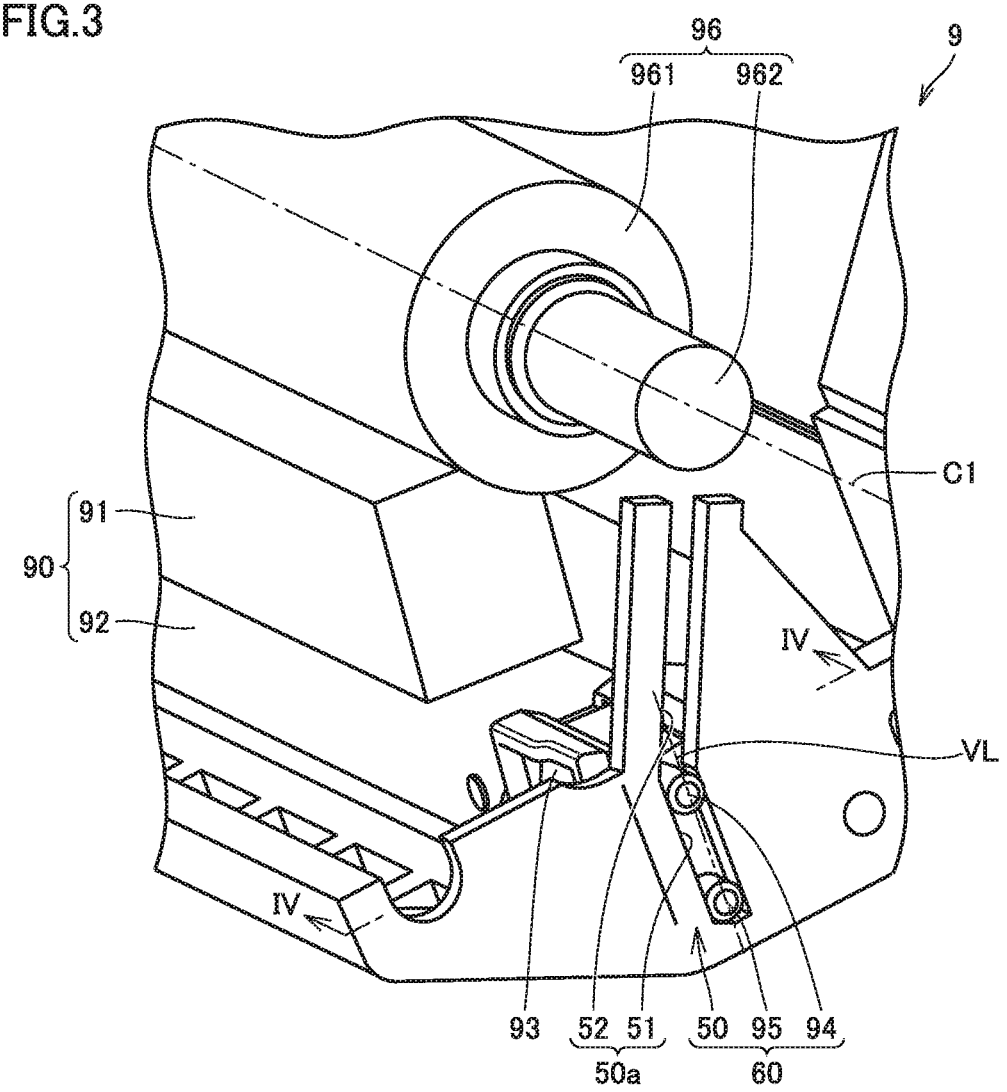
FIG. 3 is a schematic perspective view of an initial state of the solid lubricant application device according to the first embodiment.
Figure 4:
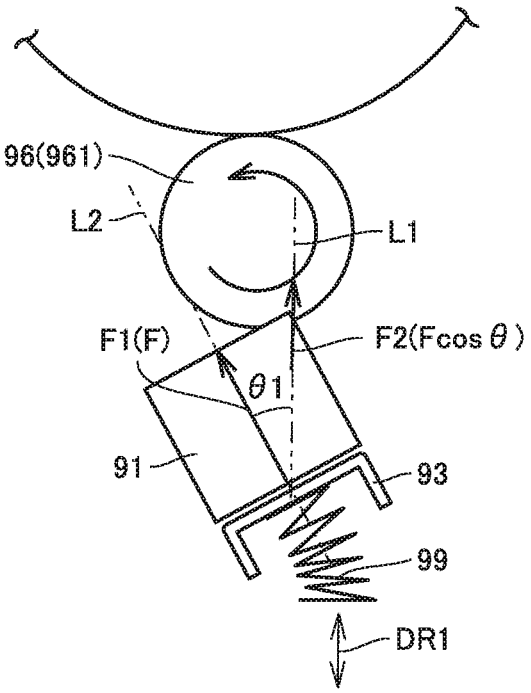
FIG. 4 is a diagram for illustrating forces acting on the solid lubricant and the brush roller in the initial state according to the first embodiment.

FIG. 3 is a schematic perspective view of an initial state of the solid lubricant application device according to the first embodiment. FIG. 4 is a diagram for illustrating forces acting on the brush roller in the initial state according to the first embodiment. With reference to FIGS. 3 and 4, a detailed configuration of solid lubricant application device 9 and the initial state of solid lubricant application device 9 according to the first embodiment will be described. The initial state of solid lubricant application device 9 refers to a state in which resilient urging member 99 is compressed and solid lubricant 91 in an unused state abuts against brush roller 96.

In addition to solid lubricant 91, support member 92, brush roller 96, and resilient urging member 99, solid lubricant application device 9 further includes a guide mechanism 60.

Brush roller 96 has a brush portion 961 and an axial core portion 962. Axial core portion 962 has a cylindrical shape. Brush portion 961 is configured by setting out brush bristles on a circumferential surface of aerial core portion 962. Axial core portion 962 has an axis of rotation C1, and rotates about the axis of rotation C1.

Solid lubricant 91 is generally in the form of a rectangular parallelepiped extending in a direction parallel to the axis of rotation C1 of brush roller 96.

Typically, solid lubricant 91 can be a powdery metallic soap molten and shaped. Solid lubricant 91 can for example be a metal soap such as zinc stearate. A coating formed of zinc stearate is characterized by high mold releasability (i.e., a large pure water contact angle) and a small coefficient of friction, and is excellent in transferability and cleanability and can also suppress wear of photoreceptor 1 to allow it to have a long life.

Support member 92 supports solid lubricant 91. Support member 92 supports solid lubricant 91 on a side opposite to brush roller 96 with solid lubricant 91 interposed. Support member 92 has an elongate shape extending in a direction parallel to the axis of rotation C1.

Support member 92 has a housing unit 93, and a first guided portion 94 and a second guided portion 95. Housing unit 93 is provided on sides of opposite ends of support member 92 in a direction parallel to the axis of rotation C1. Housing unit 93 has a bottomed shape such that housing unit 93 is opened at one end side opposite to brush roller 96 in a direction parallel to a direction in which brush roller 96 and solid lubricant 91 are aligned. Housing unit 93 houses resilient urging member 99 therein.

First guided portion 94 and second guided portion 95 project in a direction parallel to the axis of rotation C1 from an external peripheral surface of housing unit 93. First guided portion 94 and second guided portion 95 have a generally cylindrical shape.

Guide mechanism 61) guides movement of solid lubricant 91 caused as solid lubricant 91 is applied to brush roller 96 and accordingly changed in shape. Guide mechanism 60 includes first guided portion 94, second guided portion 95, and a guide member 50.

Guide member 50 is provided to be erect from a bottom of lubricant application adjustment unit 7. Guide member 50 has a guide path 50*a*. Guide path 50*a* guides first guided portion 94 and second guided portion 95.

Guide path 50*a* has a first path 51 and a second path 52. First path 51 guides movement of first guided portion 94 and second guided portion 95 so that an intersecting angle θ1 described later (see FIG. 4) is relatively large. Second path 52 guides movement of first guided portion 94 and second guided portion 95 so that intersecting angle θ1 is relatively small.

First path 51 is inclined relative to the direction of the central axis of resilient urging 99 in an uncompressed state (i.e., a direction DR1 in FIG. 4). Second path 52 extends in a direction different than first path path 51, and for example extends in the direction parallel to the direction of the central of resilient urging member 99 in the uncompressed state.

As shown in FIG. 4, in the initial state, resilient urging member 99 is compressed such that the central axis is curved. An end of resilient urging member 99 closer to solid lubricant 91 is directed in the initial state frontwardly of the axis of rotation of brush roller 96 (i.e., leftward in FIG. 4). Thus, a direction in which resilient urging member 99 and solid lubricant 91 are connected inclines relative to the direction of the central axis of resilient urging member 99 in the uncompressed state (i.e., direction DR1). In other words, a straight line parallel to the direction in which resilient urging member 99 and solid lubricant 91 are connected (i.e., a second straight line L2) inclines relative to direction DR1.

In contrast, a straight line parallel to a direction in which solid lubricant 91 abuts against brush roller 96 (i.e., a first straight line L1) will be a direction parallel to direction DR1, as shown in FIG. 4. Note that the direction in which solid lubricant 91 abuts against brush roller 96 is a direction in which solid lubricant 91 presses brush roller 96.

Herein, a smaller one of angles formed by first straight line L1 and second straight line L2 is denoted as an intersecting angle θ1. Intersecting angle θ1 in the initial state is larger than that in a final state in which solid lubricant 91 is considerably consumed.

With intersecting angle θ1, when a force F1 exerted by elastic urging member 99 to press solid lubricant 91 is represented as F, a force F2 exerted by solid lubricant 91 to press brush roller 96 will be F cos θ.

When first guided portion 94 and second guided portion 95 are moving along first path 51, intersecting angle θ1 is relatively large. As solid lubricant 91 is applied to brush roller 96 and accordingly changed in shape, first guided portion 94 moves along first path 51 and second guided portion 95 moves along second path 52. In this state, a virtual straight line VL which connects first guided portion 94 and second guided portion 95 rotates about an axis parallel to the axis of rotation C1 of brush roller 96. Accordingly, intersecting angle θ1 will decrease.

First guided portion 94 and second guided portion 95 are guided by guide path 50*a* so that virtual straight line VL connecting first guided portion 94 and second guided portion 95 rotates about the axis parallel to the axis of rotation C1 of brush roller 96 as solid lubricant 91 is applied to a rotating body and accordingly changed in shape.

Figure 5:
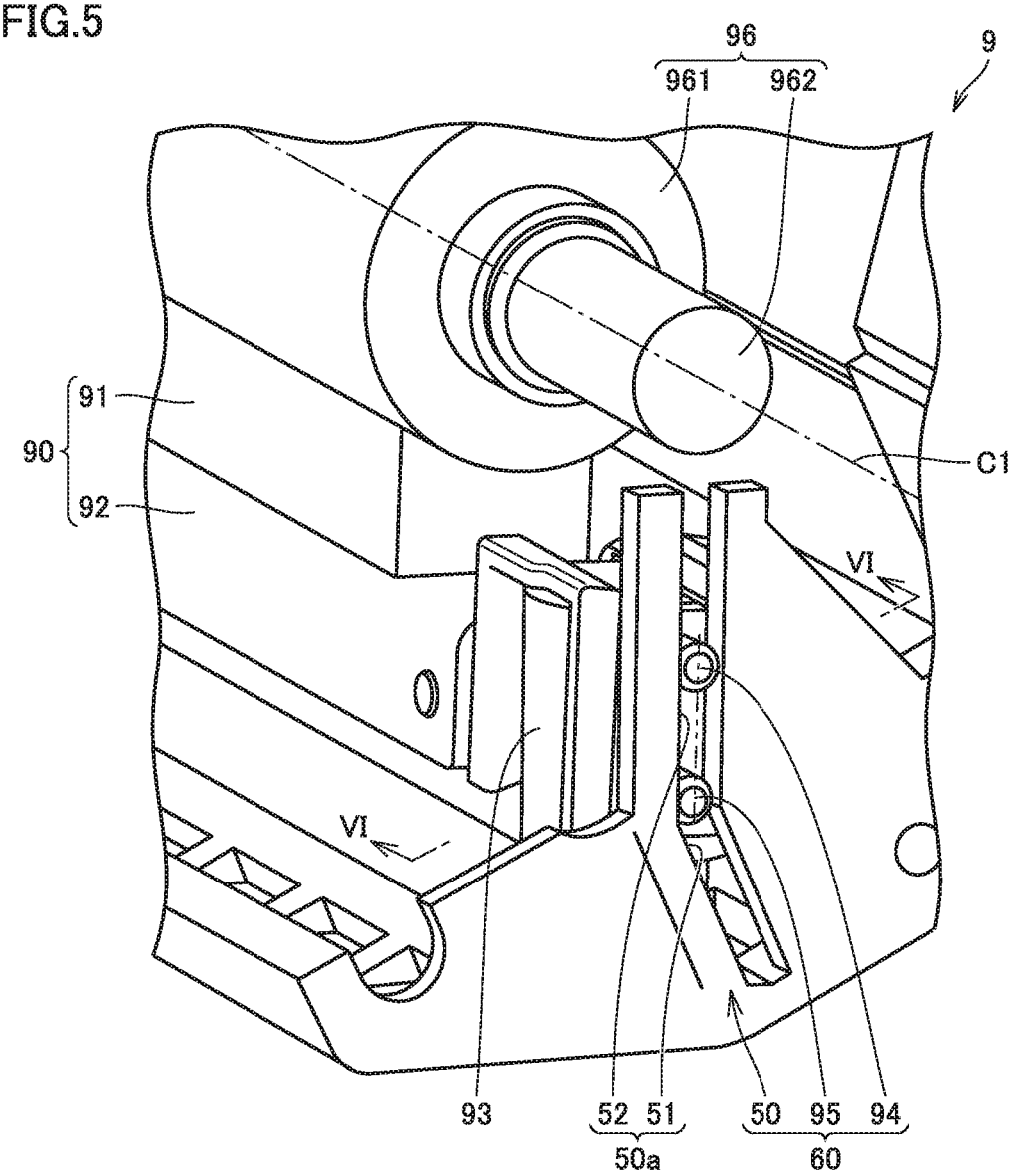
FIG. 5 is a schematic perspective view of a final state of the solid lubricant application device according to the first embodiment.
Figure 6:
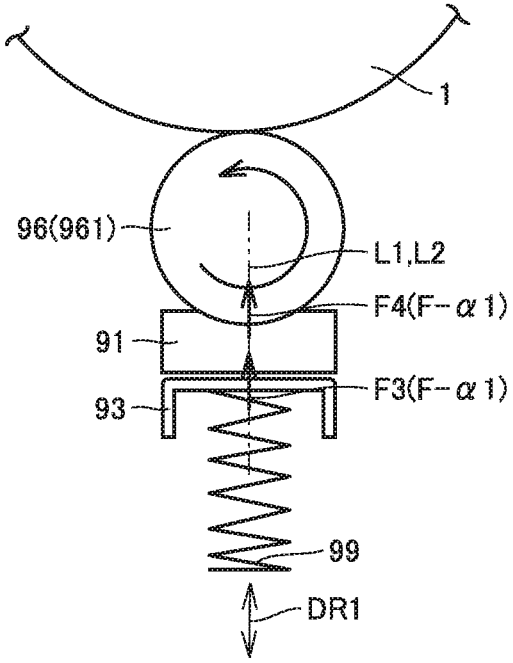
FIG. 6 is a diagram for illustrating forces acting on the solid lubricant and the brush roller in the final state according to the first embodiment.

FIG. 5 is a schematic perspective view of a finial state of the solid lubricant application device according to the first embodiment. FIG. 6 is a diagram for illustrating forces acting on the solid lubricant and the brush roller in the final state according to the first embodiment. With reference to FIG. 5 and FIG. 6, the final state of solid lubricant application device 9 will be described. Note that the final state of solid lubricant application device 9 refers to a state where solid lubricant 91 has been consumed to a considerable extent.

As shown in FIG. 5 and FIG. 6, in the final state, first guided portion 94 and second guided portion 95 are guided to second path 52, and solid lubricant 91 has a posture changed as compared with the initial state. Furthermore, resilient urging member 99 is compressed such that it has the central axis extending linearly. In the final state the end of resilient urging member 99 closer to solid lubricant 91 is directed toward the axis of rotation of brush roller 96. Thus, the direction in which resilient urging member 99 and solid lubricant 91 are connected matches direction DR1 of the central axis of resilient urging member 99 in the uncompressed state. In other words, the straight line parallel to the direction in which resilient urging member 99 and solid lubricant 91 are connected second straight line L2) matches direction DR1.

The straight line parallel to the direction in winch solid lubricant 91 abuts against brush taller 96 (i.e., first straight line L1) will be a direction parallel to direction DR1. Thus, intersecting angle θ1 of first straight line L1 and second straight line L2 will substantially be 0 degree, and is smaller than in the initial state.

Accordingly, in the final state, a force F3 exerted by resilient urging member 99 to press solid lubricant 91 will be transmitted directly to brush roller 96. As a result, force F3 exerted by resilient urging member 99 to press solid lubricant 91 is equal to a force F4 exerted by solid lubricant 91 to press brush roller 96.

In the final state, resilient urging member 99 is in a stretched state as compared with the initial state. Thus, force F3 exerted by resilient urging member 99 to press solid lubricant 91 in the final state is smaller than force F1 exerted by resilient urging member 99 to press solid lubricant 91 in the initial state, and is represented by F-α1. Force F4 exerted by solid lubricant 91 to press brush roller 96 is equal to force F3 exerted by resilient urging member 99 to press solid lubricant 91 in the final slate, F-α1.

Figure 7:
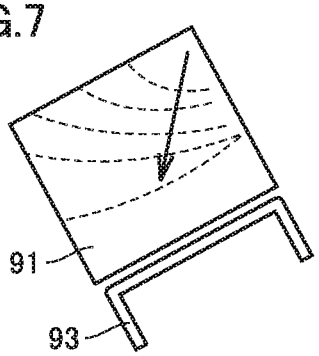
FIG. 7 is a diagram for illustrating how the solid lubricant is reduced according to the first embodiment.

FIG. 7 is a diagram for illustrating how the solid lubricant is reduced according to the first embodiment. With reference to FIG. 7, how the solid lubricant is reduced according to the first embodiment will be described. In FIG. 7, for the sake of convenience, solid lubricant 91 is shown to assume a fixed posture, and in each state, a surface of solid lubricant 91 in contact with brush roller 96 is indicated by a broken line.

As shown in FIG. 7, in the initial slate, solid lubricant 91 has a corner and a vicinity thereof abutting against brush roller 96, and in the final state, solid lubricant 91 has a central portion abutting against brush roller 96. As solid lubricant 91 thus has its posture changed, solid lubricant 91 contacts brush roller 96 in an increasing area from the initial state toward the final state.

Comparative Example

Figure 8:
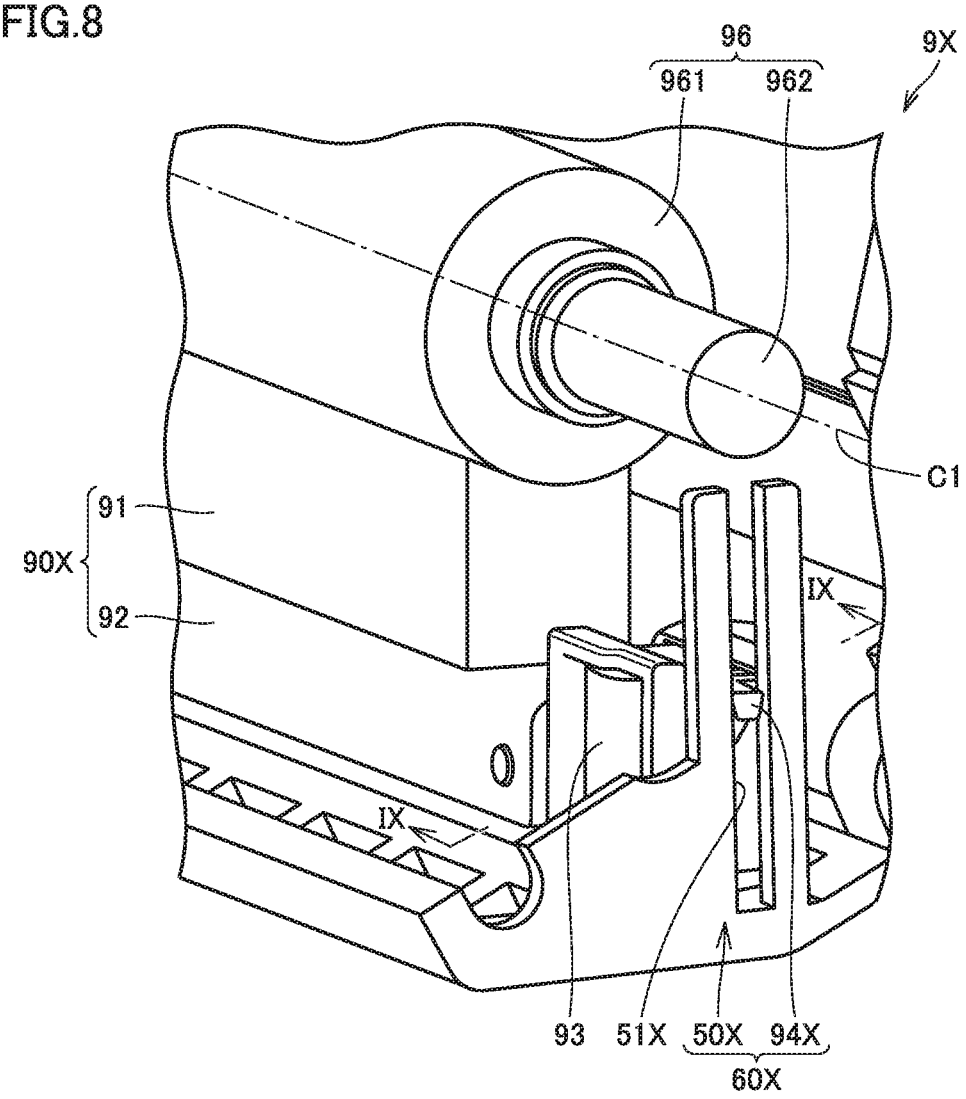
FIG. 8 is a schematic perspective view of an initial state of a solid lubricant application device according to a comparative example.
Figure 9:
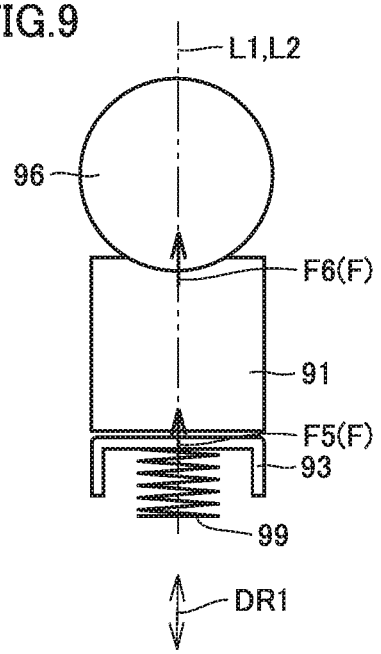
FIG. 9 is a diagram for illustrating forces acting on the solid lubricant and the brush roller in the initial state according to the comparative example.

FIG. 8 is a schematic perspective view of an initial state of a solid lubricant application device according to a comparative example. FIG. 9 is a diagram for illustrating forces acting on the solid lubricant and the brush roller in the initial state according to the comparative example. With reference to FIGS. 8 and 9, a solid lubricant application device 9X according to the comparative example and the initial state of solid lubricant application device 9X will be described.

As shown in FIG. 8, when solid lubricant application device 9X according to the comparative example is compared with solid lubricant application device 9 according to the first embodiment, the former has a guide mechanism 60X configured to be different than the latter. The remainder in configuration is substantially the same.

Guide mechanism 60X includes a guide member 50X and a first guided portion 94X. Guide member 50X has a guide path 51X. Guide path 51X is provided linearly. Guide path 51X extends in a direction parallel to the central axis of resilient urging member 99 in the uncompressed state. Housing unit 93 of support member 92 is provided with first guided portion 94X alone. Guide path 51X guides movement of first guided portion 94X.

As shown in FIG. 9, in the initial state, resilient urging member 99 is compressed so that it has a central axis linearly, and a direction in which resilient urging member 99 is connected to solid lubricant 91 matches the direction of the central axis of resilient urging member 99 (i.e., direction DR1). Furthermore, the direction in which solid lubricant 91 abuts against brush roller 96 matches the direction of the central axis of resilient urging member 99 (i.e., direction DR1).

That is, the straight line parallel to the direction in which solid lubricant 91 abuts against brush roller 96 (i.e. first straight liter L1) matches the straight line parallel to the direction, in which resilient urging member 99 and solid lubricant 91 are connected (i.e., second straight line L2), and intersecting angle θ1 of first straight line L1 and second straight line L2 is substantially 0 degree.

Accordingly, in the initial state, a force F5 exerted by resilient urging member 99 to press solid lubricant 91 will be transmitted directly to brush roller 96. As a result, force F5 exerted by resilient urging member 99 to press solid lubricant 91 is equal to a force F6 exerted by solid lubricant 91 to press brush roller 96. In this case, F5 and F6 can be represented as F.

As solid lubricant 91 is applied to brush roller 96 and accordingly changed in shape, first guided portion 94 moves along guide path 51X. As has been set forth above, guide path 51X extends in the direction parallel to the direction of the central axis of resilient urging member 99, and accordingly, support member 92 moves without rotating about a axis parallel to the axis of rotation C1 of brush roller 96. Thus, solid lubricant 91 moves with its posture fixed.

Figure 10:
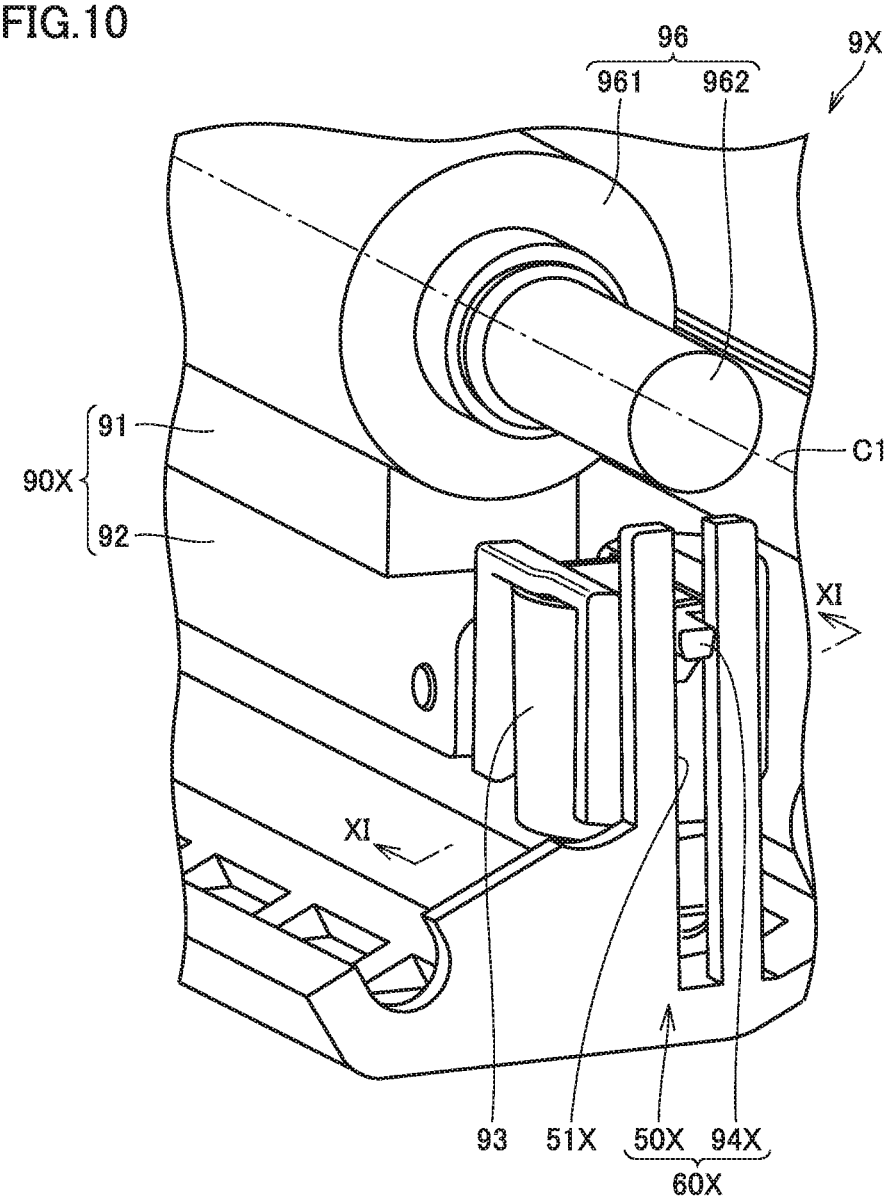
FIG. 10 is a schematic perspective view of a final state of the solid lubricant application device according to the comparative example.
Figure 11:
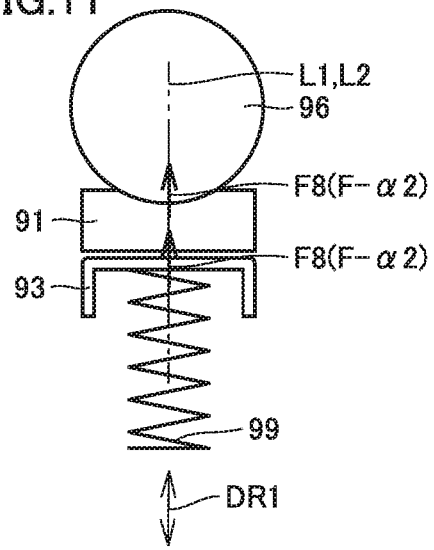
FIG. 11 is a diagram for illustrating forces acting on the solid lubricant and the brush roller in the final state according to the comparative example.

FIG. 10 is a schematic perspective view of a final state of the solid lubricant application device according to the comparative example. FIG. 11 is a diagram for illustrating forces acting on the solid lubricant and the brush roller in the final state according to the comparative example. With reference to FIG. 10 and FIG. 11, the final state of solid lubricant application device 9X according to the comparative example will be described.

As shown in FIGS. 10 and 11, in the final state also, the direction in which resilient urging member 99 is connected to solid lubricant 91 matches the direction of the central axis of resilient urging member 99 (i.e., direction DR1). Furthermore, the direction in which solid lubricant 91 abuts against brush roller 96 matches the direction of the central axis of resilient urging member 99 (i.e. direction DR1).

That is, the straight line parallel to the direction in which sol id lubricant 91 abuts against brush roller 96 (i.e., first straight line L1) matches the straight line parallel to the direction in which resilient urging member 99 and solid lubricant 91 are connected (i.e., second straight line L2), and intersecting angle α1 of first straight line L1 and second straight line L2 is substantially 0 degree.

Accordingly, in the final state also, a force F7 exerted by resilient urging member 99 to press solid lubricant 91 will be transmitted directly to brush roller 96. As a result, force F7 exerted by resilient urging member 99 to press solid lubricant 91 is equal to a force F8 exerted by solid lubricant 91 to press brush roller 96.

In the final state, resilient urging member 99 is in a stretched state as compared with the initial state. Thus, force F7 exerted by resilient urging member 99 to press solid lubricant 91 in the final state is smaller than force F5 exerted by resilient urging member 99 to press solid lubricant 91 in the initial state, and is represented by F-α2. Force F8 exerted by solid lubricant 91 to press brush roller 96 is equal to force F7 exerted by resilient urging member 99 to press solid lubricant 91 in the final state, F-α2.

Effect of First Embodiment as Compared with Comparative Example

Figure 12:
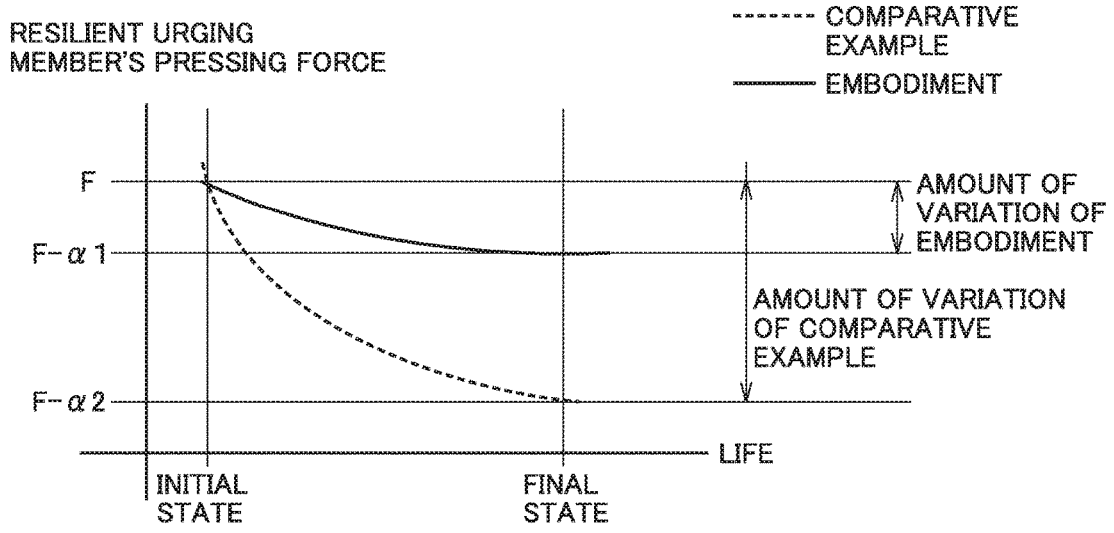
FIG. 12 is a graph showing variation of a force exerted by the solid lubricant to press the brush roller from the initial stale toward the final state in the first embodiment and variation of a force exerted by the solid lubricant to press the brush roller from the initial state toward the final state in the comparative example.

FIG. 12 is a graph showing variation of a force exerted by the solid lubricant to press the brush roller from the initial state toward the final state in the first embodiment and variation of a force exerted by the solid lubricant to press the brush roller from the initial state toward the final state in the comparative example. With reference to FIG. 12, variation of a force exerted by the solid lubricant to press the brush roller from the initial state toward the final state will be described.

As shown in FIG. 12, in the initial state, a force exerted by resilient urging member 99 to press solid lubricant 91 in the first embodiment is substantially constant. In the first embodiment, in the initial state, solid lubricant 91 has a corner and a vicinity thereof abutting against brush roller 96, and in the final state, solid lubricant 91 has a central portion abutting against brush roller 96. Thus, while solid lubricant 91 is changed in posture, resilient urging member 99 is restored, and resilient urging member 99 is stretched from the initial state toward the final state in an amount smaller than that in the comparative example with solid lubricant 91 in a fixed posture.

Accordingly, in the first embodiment, a variation in a pressing force accompanying an amount of variation of resilient urging member 99 will be suppressed more than in the comparative example. That is, $\alpha 1 < \alpha 2$ is achieved, and in the final state, force F3 exerted by resilient urging member 99 to press solid lubricant 91 in the first embodiment (i.e., F-α1) is larger than force F7 exerted by resilient urging member 99 to press solid lubricant 91 in the comparative example, (i.e., F-α2).

Figure 13:
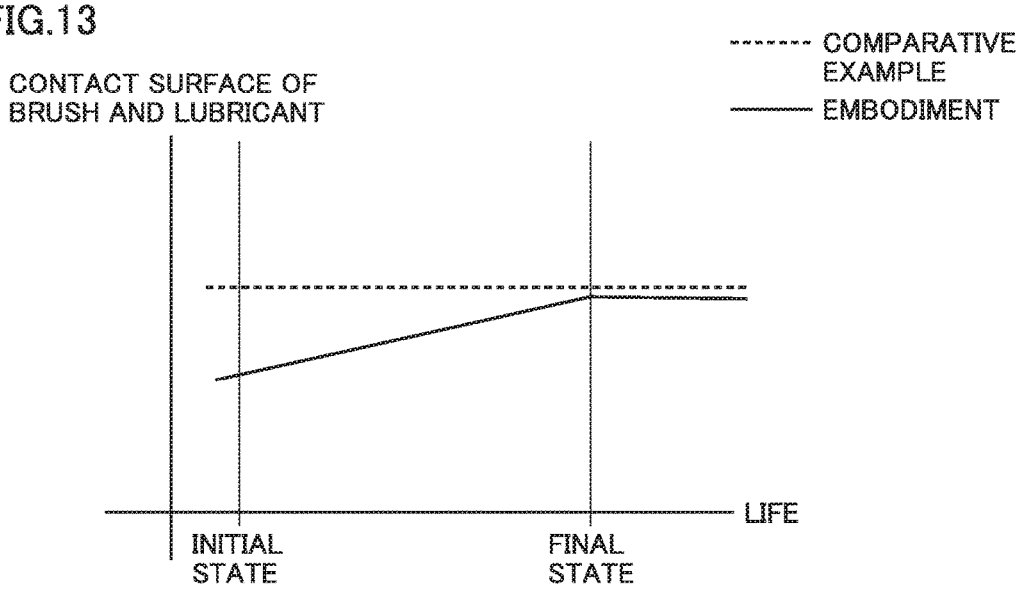
FIG. 13 is a diagram showing how a contact area between the brush roller and the solid lubricant changes from the initial state toward the final state in the first embodiment.

FIG. 13 is a diagram showing how a contact area between the brush roller and the solid lubricant changes from the initial state toward the final state in the first embodiment. With reference to FIG. 13, how the contact area between the brush roller and the solid lubricant changes from the initial state toward the final state will be described.

In the first embodiment, as solid lubricant 91 has its posture changed, as has been set forth above, the solid lubricant contacts the brush roller in an increasing area from the initial state toward the final state. That is, a contact area with intersecting angle θ1 being relatively large is smaller than a contact area with intersecting angle θ1 being relatively small.

Thus, in solid lubricant application device 9 according to the first embodiment, guide mechanism 60 guides movement of solid lubricant 91 so that intersecting angle θ1 decreases as the solid lubricant is applied to the brush roller and accordingly changed in shape.

This allows resilient urging member 99 to be stretched from the initial state toward the final state in an amount smaller than that in the comparative example with solid lubricant 91 in a fixed posture. Thus, in the final state, force F3 exerted by resilient urging member 99 to press solid lubricant 91 in the first embodiment can be larger than force F7 exerted by resilient urging member 99 to press solid lubricant 91 in the comparative example with solid lubricant 91 in a fixed posture. This can result in suppressing variation of a force exerted by solid lubricant 91 to press brush roller 96 varying from an initial state in which solid lubricant 91 is initially installed toward a final state in which solid lubricant 91 is considerably consumed.

Second Embodiment

Figure 14:
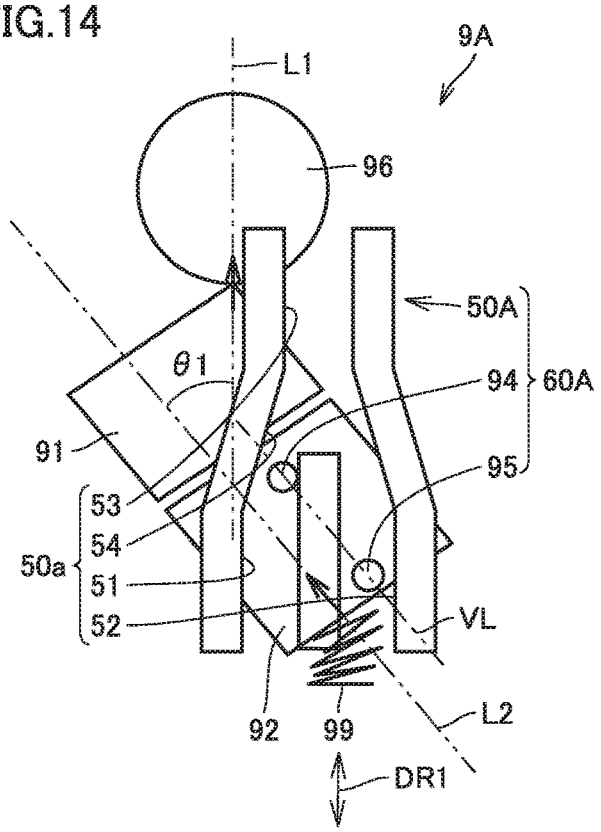
FIG. 14 is a side view showing a first state of a solid lubricant application device according to a second embodiment.
Figure 15:
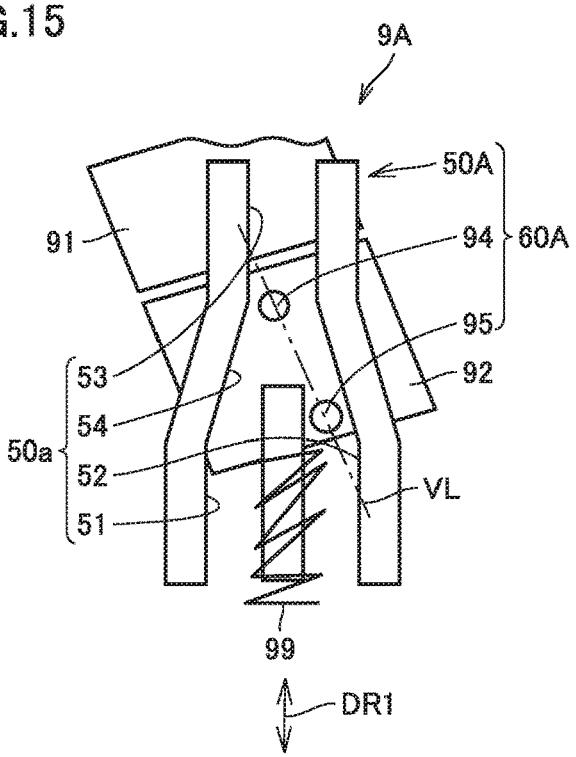
FIG. 15 is a side view showing second state of the solid lubricant application device according to the second embodiment.
Figure 16:
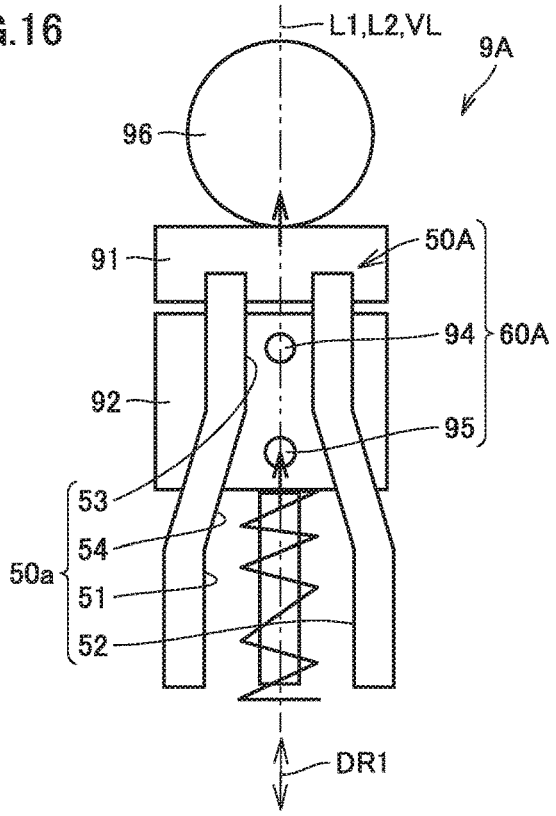
FIG. 16 is a side view showing a third state of the solid lubricant application device according to the second embodiment.

FIG. 14 is a side view showing a first state of a solid lubricant application device according to a second embodiment. FIG. 15 is a side view showing a second state of the solid lubricant application device according to the second embodiment. FIG. 16 is a side view showing a third state of the solid lubricant application device according to the second embodiment. Note that the first state is a state close to the initial state according to the first embodiment, the third state is a state close to the final state according to the first embodiment, and the second state is a state intermediate between the first state and the third state. With reference to FIG. 14 to FIG. 16, a solid lubricant application device 9A according to the second embodiment will be described.

As shown in FIG. 14 to FIG. 16, when solid lubricant application device 9A according to the second embodiment is compared with solid lubricant application device 9 according to the first embodiment, the former has a guide mechanism 60A configured to be different than the latter. The remainder in configuration is substantially the same.

Guide mechanism 60A includes a guide member 50A, and first guided portion 94 and second guided portion 95. First guided portion 94 is located closer to brush roller 96 than second guided portion 95.

Guide member 50A has first path 51, second path 52, a confluence portion 54, and a third path 53. First path 51 and second path 52 are disposed side by side. First path 51 and second path 52 extend toward brush roller 96. Specifically, first path 51 and second path 52 extend in the direction of the central axis DR1 with resilient urging member 99 in the uncompressed state.

Confluence portion 54 is a portion at which first path 51 and second path 52 join together. Confluence portion 54 connects first and second paths 51 and 52 and third path 53 together. Confluence portion 54 becomes narrower from the side of first and second paths 51 and 52 toward that of third path 53.

Third path 53 extends from confluence portion 54 in a direction in which first path 51 and second path 52 extend. Third path 53 is located closer to brush roller 96 than first path 51 and second path 52.

As shown in FIG. 14, in the first state, first guided portion 94 is located within first path 51, and second guided portion 95 is located within second path 52. Resilient urging member 99 is compressed such that it has the central axis curved.

Thus, a direction in which resilient urging member 99 and solid lubricant 91 are connected inclines relative to direction DR1 of the central axis of resilient urging member 99 in the uncompressed state. In other words, a straight line parallel to the direction in which resilient urging member 99 and solid lubricant 91 are connected (i.e., second straight line L2) inclines relative to direction DR1.

In contrast, a straight line parallel to a direction in which solid lubricant 91 abuts against brush roller 96 (i.e., first straight line L1) will be a direction parallel to direction DR1, as shown in FIG. 14.

Intersecting angle θ1 in the first state is larger than that in the third state in which solid lubricant 91 is considerably consumed.

First path 51 and second path 52 guide first guided portion 94 and second guided portion 95, respectively, so that intersecting angle θ1 is relatively large. First guided portion 94 reaches confluence portion 54 before second guided portion 95 does.

As shown in FIG. 15, in the second state, first guided portion 94 is located within confluence portion 54, and second guided portion 95 is located within second path 52. In this state, in which direction second guided portion 95 moves is determined by second path 52. In contrast, while first guided portion 94 is guided by an inclined wall of confluence portion 54, first guided portion 94 moves within confluence portion 54 depending on a state of restoration of resilient urging member 99.

Specifically, while second guided portion 95 is guided by second path 52 to move, first guided portion 94 rotates about second guided portion 95 about an axis parallel to the axis of rotation C1 of brush roller 96.

That is, first guided portion 94 and second guided portion 95 are guided by guide path 50*a* so that virtual straight line VL connecting first guided portion 94 and second guided portion 95 rotates about the axis parallel to the axis of rotation C1 as solid lubricant 91 is applied to a rotating body and accordingly changed in shape. Accordingly, intersecting angle θ1 will decrease. Furthermore, solid lubricant 91 also has its posture changed.

As shown in FIG. 16, in the third state, first guided portion 94 is located in third path 53, and second guided portion 95 is located in confluence portion 54. First guided portion 94 and second guided portion 95 are aligned in the direction of the central axis of resilient urging member 99 in the uncompressed state (i.e., direction DR1).

In this state, resilient urging member 99 is compressed so that resilient urging member 99 has its central axis linearly extending. The direction in which resilient urging member 99 and solid lubricant 91 are connected matches direction DR1 of the central axis of resilient urging member 99 in the uncompressed state. In other words, the straight line parallel to the direction in which resilient urging member 99 and solid lubricant 91 are connected (i.e., second straight line L2) matches direction DR1.

The straight line parallel to the direction in which solid lubricant 91 abuts against brush roller 96 (i.e., first straight line L1) will be a direction parallel to direction DR1. Thus, intersecting angle θ1 of first straight line L1 and second straight line L2 will substantially be 0 degree, and is smaller than in the first state.

By being thus configured, solid lubricant application device 9A according to the second embodiment is substantially as effective as solid lubricant application device 9 according to the first embodiment.

Third Embodiment

Figure 17:
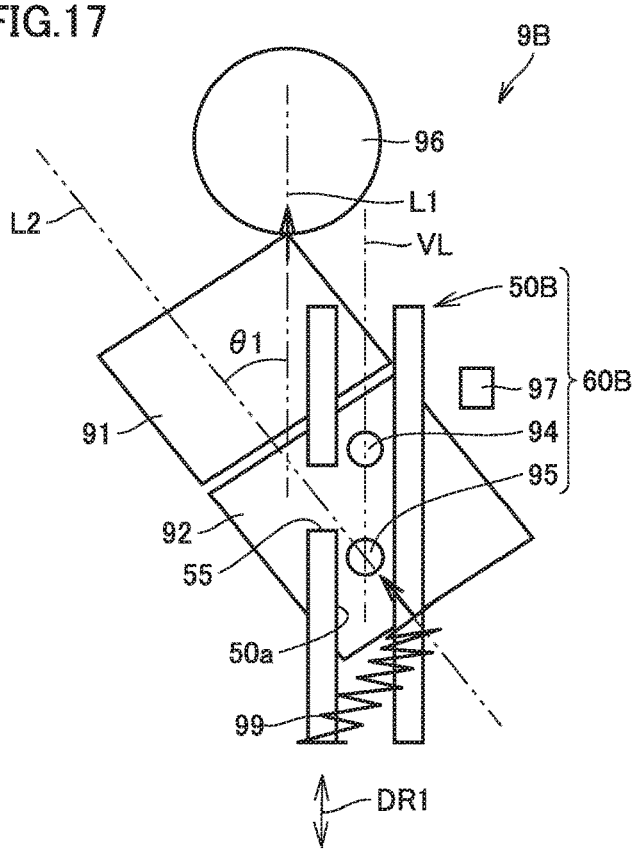
FIG. 17 is a side view showing a first state of a solid lubricant application device according to a third embodiment.
Figure 18:
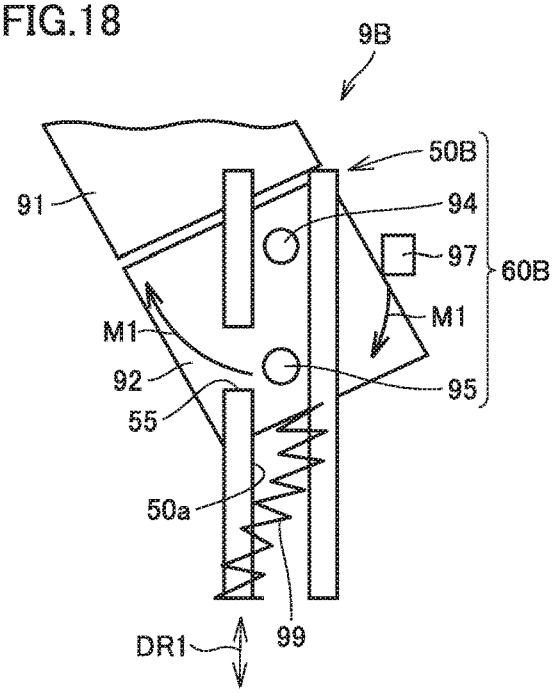
FIG. 18 is a side view showing a second state of the solid lubricant application device according to the third embodiment.
Figure 19:
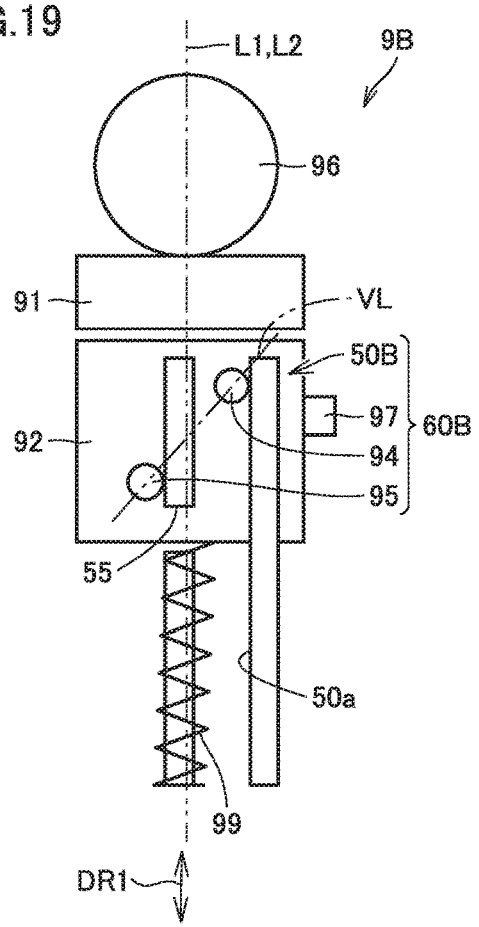
FIG. 19 is a side view showing a third state of the solid lubricant application device according to the third embodiment.

FIG. 17 is a side view showing a first state of a solid lubricant application device according to a third embodiment. FIG. 18 is a side view showing a second state of the solid lubricant application device according to the third embodiment. FIG. 19 is a side view showing a third state of the solid lubricant application device according to the third embodiment. Note that the first stale is a state close to the initial state according to the first embodiment, the third state is a state close to the final state according to the first embodiment, and the second state is a slate intermediate between the first state and the third state. With reference to FIG. 17 to FIG. 19, a solid lubricant application device 9B according to the third embodiment will be described.

As shown in FIG. 17 to FIG. 19, when solid lubricant application device 9B according to the third embodiment is compared with solid lubricant application device 9 according to the first embodiment, the former has a guide mechanism 60B configured to be different than the latter. The remainder in configuration is substantially the same.

Guide mechanism 60B includes a guide member 50B, and first guided portion 94 and second guided portion 95, and in addition, an abutment portion 97. First guided portion 94 is located closer to brush roller 96 than second guided portion 95.

Guide member 50B has guide path 50*a*. Guide path 50*a* has an intermediate portion with an opening 55 for moving second guided portion 95 to an outside of guide path 50*a*.

Abutment portion 97 abuts against support member 92 to generate a moment about an axis parallel to the axis of rotation C1 of brush roller 96 to rotate support member 92 so that second guided portion 95 is moved to an outside of opening 55 and the intersecting angle is thus decreased.

As shown in FIG. 17, in the first state, first guided portion 94 is located within guide path 50*a* closer to brush roller 96 than opening 55. Second guided portion 95 is located closer to resilient urging member 99 than opening 55. Resilient urging member 99 is compressed such that it has the central axis curved.

Thus, a direction in which resilient urging member 99 and solid lubricant 91 are connected inclines relative to direction DR1 of the central axis of resilient urging member 99 in the uncompressed state. In other words, a straight line parallel to the direction in which resilient urging member 99 and solid lubricant 91 are connected (i.e., second straight line L2) inclines relative to direction DR1.

A straight line parallel to a direction in which solid lubricant 91 abuts against brush roller 96 (i.e., first straight line L1) will be a direction parallel to direction DR1, as shown in FIG. 17.

Intersecting angle θ1 of first straight line L1 and second straight line L2 in the first state is larger thin that in the third state in which solid lubricant 91 is considerably consumed.

Until second guided portion 95 reaches opening 55, guide path 50*a* guides first guided portion 94 and second guided portion 95 so that intersecting angle θ1 is relatively large.

As shown in FIG. 18, when second guided portion 95 reaches opening 55, support member 92 abuts against abutment portion 97. From this state, as first guided portion 94 is guided by guide path 50*a* depending on a state of restoration of resilient urging member 99, support member 92 is pressed by abutment portion 97. On this occasion, a moment M1 about an axis parallel to the axis of rotation C1 of brush voiles 96 acts on support member 92. Thus, support member 92 rotates about the axis parallel to the axis of rotation C1. As a result, second guided portion 95 moves to an outside of opening 55, and intersecting angle θ1 is reduced.

As shown in FIG. 19 in the third state, first guided portion 94 is located in guide path 50*a*, and second guided portion 95 is located outside guide member 50B.

In this state, resilient urging member 99 is compressed so that resilient urging member 99 has its central axis linearly extending. The direction in which resilient urging member 99 and solid lubricant 91 are connected matches direction DR1 of the central axis of resilient urging member 99 in the uncompressed state. In other words, the straight line parallel to the direction in which resilient urging member 99 and solid lubricant 91 are connected second straight line L2) matches direction DR1.

The straight line parallel to the direction in which solid lubricant 91 abuts against brush roller 96 (i.e., first straight line L1) will be a direction parallel to direction DR1. Thus, intersecting angle θ1 of first straight line L1 and second straight line L2 is substantially 0 degree, and is smaller than in the first state.

By being thus configured, solid lubricant application device 9B according to the third embodiment is substantially as effective as solid lubricant application device 9 according to the first embodiment.

Fourth Embodiment

Figure 20:
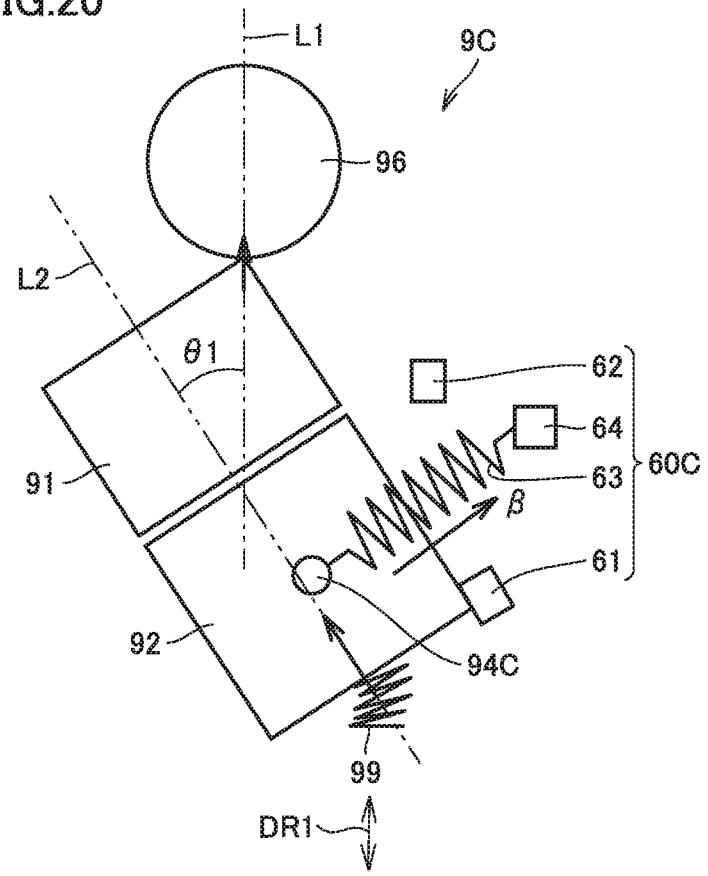
FIG. 20 is a side view showing first state of a solid lubricant application device according to a fourth embodiment.

FIG. 20 is a side view showing a first state of a solid lubricant application device according to a fourth embodiment. FIG. 21 is a side view showing a second state of the solid lubricant application device according to the fourth embodiment. FIG. 22 is a side view showing a third state of the solid lubricant application device according to the fourth embodiment. With reference to FIG. 20 to FIG. 22, a solid lubricant application device 9C according to the fourth embodiment will be described.

As shown in FIG. 20 to FIG. 22, when solid lubricant application device 9C according to the fourth embodiment is compared with solid lubricant application device 9 according to the third embodiment, the former has a guide mechanism 60C configured to be different than the latter. The remainder in configuration is substantially the same.

Guide mechanism 60C includes a first restraint portion 61 and a second restraint portion 62, and a resilient member 63. First restraint portion 61 is in the form of a block having a planar surface inclined relative to the direction of the central axis of resilient urging member 99 in the uncompressed state (i.e., direction DR1). First restraint portion 61 restrains solid lubricant 91 by the planar surface in posture so that intersecting angle θ1 is large.

Second restraint portion 62 is in the form of a block having a planar surface parallel to the direction of the central axis of resilient urging member 99 in the uncompressed state (i.e., direction DR1). Second restraint portion 62 restrains solid lubricant 91 by the planar surface in posture so that intersecting angle θ1 is small.

When observed in the direction of the axis of rotation C1 of brush roller 96, resilient member 63 is provided to pass between first restraint portion 61 and second restraint portion 62. Resilient member 63 has one end side fixed to a projection 94C provided on an external peripheral surface of housing unit 93 of support member 92. Resilient member 63 has the other end side fixed to a secured portion 64. Projection 94C is energized by resilient member 63 toward secured portion 64.

Resilient member 63 moves solid lubricant 91 to reduce intersecting angle θ1 when first restraint portion 61 no longer provides restraint as solid lubricant 91 is applied to brush roller 96 and accordingly changed in shape.

As shown in FIG. 20, in the first state, resilient urging member 99 is compressed such that it has the central axis curved, and housing unit 93 of support member 92 abuts against first restraint portion 61.

A direction in which resilient urging member 99 and solid lubricant 91 are connected inclines relative to direction DR1 of the central axis of resilient urging member 99 in the uncompressed state. In other words, a straight line parallel to the direction in which resilient urging member 99 and solid lubricant 91 are connected (i.e., second straight line L2) inclines relative to direction DR1.

A straight line parallel to a direction in which solid lubricant 91 abuts against brush roller 96 (i.e., first straight line L1) will be a direction parallel to direction DR1, as shown in FIG. 20.

Intersecting angle θ1 of first straight line L1 and second straight line L2 in the first state is larger than that in the third state in which solid lubricant 91 is considerably consumed.

As shown in FIG. 21, as solid lubricant 91 is applied to brush roller 96 and accordingly changed in shape, resilient urging member 99 is restored, and once solid lubricant 91 has been separated from first restraint portion 61, first restraint portion 61 no longer provide restraint. Thus, solid lubricant 91 is pulled by resilient member 63 and moves toward seemed portion 64. As a result, solid lubricant 91 has intersecting angle θ1 decreased.

As shown in FIG. 22, in the third state, resilient urging member 99 is compressed so that resilient urging member 99 has its central axis linearly extending, and housing unit 93 of support member 92 abuts against second restraint portion 62.

Thus, the direction in which resilient urging member 99 and solid lubricant 91 are connected matches direction DR1 of the central axis of resilient urging member 99 in the uncompressed state. In other words, the straight line parallel to the direction in which resilient urging member 99 and solid lubricant 91 are connected (i.e., second straight line L2) matches direction DR1.

The straight line parallel to the direction in which solid lubricant 91 abuts against brush roller 96 (i.e., first straight line L1) will be a direction parallel to direction DR1. Thus, intersecting angle θ1 of first straight line L1 and second straight line L2 will substantially be 0 degree, and is smaller than in the first state.

By being thus configured, solid lubricant application device 9C according to the fourth embodiment is substantially as effective as solid lubricant application device 9 according to the first embodiment.

Although embodiments of the present invention have been described and illustrated in detail, it is clearly understood that the same is by way of illustration and example only and not limitation, the scope of the present invention should be interpreted by terms of the appended claims.

What is claimed is:

1. A solid lubricant application device comprising:

a rotating body that rotates about an axis of rotation;

a solid lubricant applied to the rotating body as the solid lubricant abuts against a circumferential surface of the rotating body;

a support member that supports the solid lubricant;

a resilient urging member that causes the solid lubricant to abut toward the circumferential surface of the rotating body; and a guide mechanism that guides movement of the solid lubricant caused as the solid lubricant is applied to the rotating body and accordingly changed in shape, wherein the guide mechanism includes a first guided portion and a second guided portion provided at the support member, and a guide member provided with a guide path that guides the first guided portion and the second guided portion, and wherein, when a straight line parallel to a direction in which the solid lubricant abuts against the rotating body is referred to as a first straight line, and a straight line parallel to a direction in which the resilient urging member and the solid lubricant are connected is referred to as a second straight line, the guide mechanism guides the movement of the solid lubricant such that an intersecting angle, which is a smaller one of angles formed by the first straight line and the second straight line, decreases as the first guided portion and the second guided portion are guided by the guide path so that a virtual straight line connecting the first guided portion and the second guided portion rotates about an axis parallel to the axis of rotation as the solid lubricant is applied to the rotating body and accordingly changed in shape.

2. The solid lubricant application device according to claim 1, wherein the guide path includes a first path and a second path connected to the first path, the second path extending in a direction different from the first path, and the first path and the second path guiding the first guided portion and the second guided portion such that the intersecting angle decreases as the first guided portion and the second guided portion are guided by the guide path from the first path to the second path.

3. The solid lubricant application device according to claim 1, wherein:

the first guided portion is located closer to the rotating body than the second guided portion, the guide path has a first path and a second path disposed side by side and extending toward the rotating body, a confluence portion allowing the first path and the second path to join together, and a third path extending from the confluence portion in a direction in which the first path and the second path extend, the first path and the second path guide the first guided portion and the second guided portion, respectively, so that the intersecting angle is a first angle, the confluence portion becomes narrower from a side of the first and second paths toward a side of the third path, and the third path guides the first guided portion and the second guided portion so that the intersecting angle is a second angle smaller than the first angle.

4. The solid lubricant application device according to claim 1, wherein:

the first guided portion is located closer to the rotating body than the second guided portion, the guide path has an intermediate portion with an opening for moving the second guided portion to an outside of the guide path, and the guide mechanism further includes an abutment portion that abuts against the support member to generate a moment about an axis parallel to the axis of rotation of the rotating body to rotate the support member so that the second guided portion is moved to an outside of the opening and the intersecting angle is thus decreased.

5. The solid lubricant application device according to claim 1, wherein a contact area of the solid lubricant in contact with the rotating body changes in accordance with a decrease in the intersecting angle as the solid lubricant is applied to the rotating body and accordingly changed in shape.

6. The solid lubricant application device according to claim 5, wherein the contact area increases in accordance with the decrease in the intersecting angle as the solid lubricant is applied to the rotating body and accordingly changed in shape.

7. An image formation apparatus comprising:

an image carrier that carries an image; and the solid lubricant application device according to claim 1, the solid lubricant application device applying a lubricant to the image carrier.

8. An image formation apparatus comprising:

an image carrier that carries an image; and the solid lubricant application device according to claim 2, the solid lubricant application device applying a lubricant to the image carrier.

9. An image formation apparatus comprising:

an image carrier that carries an image; and the solid lubricant application device according to claim 3, the solid lubricant application device applying a lubricant to the image carrier.

10. An image formation apparatus comprising:

an image carrier that carries an image; and the solid lubricant application device according to claim 4, the solid lubricant application device applying a lubricant to the image carrier.

11. An image formation apparatus comprising:

an image carrier that carries an image; and the solid lubricant application device according to claim 5, the solid lubricant application device applying a lubricant to the image carrier.

12. An image formation apparatus comprising:

an image carrier that carries an image; and the solid lubricant application device according to claim 6, the solid lubricant application device applying a lubricant to the image carrier.

13. A solid lubricant application device comprising:

a rotating body that rotates about an axis of rotation;

a solid lubricant applied to the rotating body as the solid lubricant abuts against a circumferential surface of the rotating body;

a resilient urging member that causes the solid lubricant to abut toward the circumferential surface of the rotating body; and a guide mechanism that guides movement of the solid lubricant caused as the solid lubricant is applied to the rotating body and accordingly changed in shape, wherein, when a straight line parallel to a direction in which the solid lubricant abuts against the rotating body is referred to as a first straight line, and a straight line parallel to a direction in which the resilient urging member and the solid lubricant are connected is referred to as a second straight line, the guide mechanism guides the movement of the solid lubricant such that an intersecting angle, which is a smaller one of angles formed by the first straight line and the second straight line, decreases as the solid lubricant is applied to the rotating body and accordingly changed in shape, and wherein the guide mechanism includes a first restraint portion that restrains a posture of the solid lubricant so that the intersecting angle is a first angle, a resilient member that moves the solid lubricant to decrease the intersecting angle when the first restraint portion no longer provides restraint as the solid lubricant is applied to the rotating body and accordingly changed in shape, and a second restraint portion that restrains the posture of the solid lubricant to maintain the intersecting angle to be a second angle smaller than the first angle.

14. An image formation apparatus comprising:

an image carrier that carries an image; and the solid lubricant application device according to claim 13, the solid lubricant application device applying a lubricant to the image carrier.

15. A method for applying a solid lubricant to a surface of an image carrier by using a solid lubricant application device including a rotating body that rotates about an axis of rotation, a solid lubricant applied to the rotating body as the solid lubricant abuts against a circumferential surface of the rotating body, a support member that supports the solid lubricant, a resilient urging member that causes the solid lubricant to abut toward the circumferential surface of the rotating body, and a guide mechanism that guides movement of the solid lubricant caused as the solid lubricant is applied to the rotating body and accordingly changed in shape, the guide mechanism including a first guided portion and a second guided portion provided at the support member and a guide member provided with a guide path that guides the first guided portion and the second guided portion, and the method comprising:

causing the rotating body to abut against the surface of the image carrier; and causing the solid lubricant to abut against the circumferential surface of the rotating body, wherein, in the causing the solid lubricant to abut against the circumferential surface of the rotating body, when a straight line parallel to a direction in which the solid lubricant abuts against the rotating body is referred to as a first straight line, and a straight line parallel to a direction in which the resilient urging member and the solid lubricant are connected is referred to as a second straight line, the guide mechanism guides the movement of the solid lubricant such that an intersecting angle, which is a smaller one of angles formed by the first straight line and the second straight line, decreases as the first guided portion and the second guided portion are guided by the guide path so that a virtual straight line connecting the first guided portion and the second guided portion rotates about an axis parallel to the axis of rotation as the solid lubricant is applied to the rotating body and accordingly changed in shape.

* * * * *